US008102330B1

(12) United States Patent
Albers

(10) Patent No.: US 8,102,330 B1
(45) Date of Patent: Jan. 24, 2012

(54) DUAL BAND CIRCULARLY POLARIZED FEED

(75) Inventor: Luke J. Albers, Thornton, CO (US)

(73) Assignee: Ball Aerospace & Technologies Corp., Boulder, CO (US)

( * ) Notice: Subject to any disclaimer, the term of this patent is extended or adjusted under 35 U.S.C. 154(b) by 186 days.

(21) Appl. No.: 12/466,177

(22) Filed: May 14, 2009

(51) Int. Cl.
*H01Q 3/22* (2006.01)
*H01P 1/165* (2006.01)

(52) U.S. Cl. ..... 343/853; 343/756; 333/21 A; 333/117

(58) Field of Classification Search ..... 333/21 A, 333/117; 343/756, 853
See application file for complete search history.

(56) References Cited

U.S. PATENT DOCUMENTS

| | | | | | |
|---|---|---|---|---|---|
| 3,921,177 | A | | 11/1975 | Munson | |
| 4,131,892 | A | | 12/1978 | Munson et al. | |
| 4,131,893 | A | | 12/1978 | Munson et al. | |
| 4,414,550 | A | | 11/1983 | Tresselt | |
| 5,001,444 | A | * | 3/1991 | Salvan et al. | 333/135 |
| 5,055,852 | A | * | 10/1991 | Dusseux et al. | 343/725 |
| 5,952,982 | A | | 9/1999 | Jorgenson et al. | |
| 5,986,616 | A | * | 11/1999 | Edvardsson | 343/853 |
| 6,081,170 | A | * | 6/2000 | Enokuma | 333/134 |
| 6,121,929 | A | | 9/2000 | Olson et al. | |
| 6,194,980 | B1 | | 2/2001 | Thon | |
| 6,515,557 | B1 | * | 2/2003 | Wangsvick et al. | 333/126 |
| 6,741,212 | B2 | | 5/2004 | Kralovec et al. | |
| 6,788,272 | B2 | | 9/2004 | McCarthy et al. | |
| 6,823,177 | B1 | | 11/2004 | Lucidarme | |
| 6,934,514 | B2 | | 8/2005 | Stenberg | |
| 7,084,717 | B2 | | 8/2006 | Okazaki et al. | |
| 7,256,649 | B2 | | 8/2007 | Ksienski et al. | |
| 7,365,695 | B2 | | 4/2008 | Thomas et al. | |
| 7,385,461 | B2 | | 6/2008 | Benedikt | |
| 7,509,112 | B2 | | 3/2009 | Fujii | |

OTHER PUBLICATIONS

"Quadrature Hybrids 90° Power Dividers/Combiners 10 kHz to 40 Ghz General Information", Mar. 21, 1996, 6 pages.

* cited by examiner

*Primary Examiner* — Benny Lee
(74) *Attorney, Agent, or Firm* — Sheridan Ross P.C.

(57) ABSTRACT

Dual band antenna systems and methods providing isolation between bands are provided. The system includes a pair of superimposed antenna radiating elements, each of which is connected to an associated feed network. The feed networks may comprise a quadrature hybrid networks. Coupling paths between the first and second feed networks are arranged such that a first component of a first signal coupled from a first feed network to a second feed network will be 180° out of phase with a second signal component of the first signal coupled from the first feed network to the second feed network at the input/output of the second feed network. The resulting destructive interference results in isolation between the bands.

18 Claims, 6 Drawing Sheets

DUAL BAND CIRCULARLY POLARIZED FEED

FIELD

A dual band antenna system is provided. More particularly, a dual band isolated feed for an antenna system that includes a pair of radiating elements is provided.

BACKGROUND

Dual band antennas have many applications. For example, systems in which transmit and receive modes are separated in bandwidth are in use or being proposed.

In systems that feature dual band operation, it is desirable to provide a single antenna aperture that supports both the transmit and receive modes. In order to operate an antenna at multiple frequency bands, diplexers have been used. In concept, diplexers separate the bandwidth of a wide band radiating structure into two narrower bands. Diplexers typically comprise filters that selectively feed low and high frequency radiating elements, and can be difficult and expensive to implement. In addition, diplexers can introduce losses, take up a significant amount of space, and add complexity and mass to an antenna assembly. Moreover, it is difficult to obtain sufficient isolation between operational bandwidths using traditional diplexer architectures.

Although diplexers have a number of shortcomings, their use is typically required in order to support dual band operation. In particular, coupling between the feeds of a dual band system limits the amount of isolation between the frequency bands. Accordingly, the user of diplexers, which take up significant space, as well as adding cost and complexity, has often been unavoidable.

In order to provide isolation between differently polarized radiators, designs have been developed that do not require separate filters in order to achieve such isolation. For example, high isolation between the input/output port for a first polarization with respect to the input/output port for an orthogonal polarization can be achieved by simultaneously feeding a pair of patches such that a portion of a first signal provided at a first input/output port destructively interferes with a second portion of that signal at the second input/output port. Such a system is described in U.S. Pat. No. 4,464,663, the entire disclosure of which is hereby incorporated herein by reference. However, that solution, which involves feeding a plurality of patches from first and second feed line systems is not applicable to systems in which different feed lines are used to supply signals at different bandwidths to different radiating elements.

Accordingly, it would be desirable to provide a dual band antenna system that provided acceptable isolation between the bands, and that avoided the need for complex filters.

SUMMARY OF THE INVENTION

Embodiments of the disclosed invention are directed to solving these and other problems and disadvantages of the prior art. In particular, methods and apparatuses for feeding a dual band microstrip patch antenna system are provided. The feed system includes a traditional 90° hybrid for each of the two radiating elements or patches. Isolation between the bands is achieved independent of coupling between the feeds.

Embodiments of the disclosed invention are directed to a dual band feed system and method. The feed generally includes a pair of superimposed radiating elements or patches. A first patch is used to transmit and/or receive signals at a first frequency band, while a second patch is used to transmit and/or receive signals at a second frequency band. Embodiments of the invention are suitable for use in connection with various antenna systems, including phased array antenna systems.

In accordance with embodiments of the disclosed invention, the pair of radiating elements or patches are stacked with respect to one another. A first feed network comprises a 90° hybrid that feeds the first patch through first and second antenna element ports at 0° and 90°, and the second feed network comprises a 90° hybrid that feeds the second patch through first and second antenna element ports at 0° and 90°. Moreover, the signals provided to the patches can be circularly polarized. The first and second antenna element ports feeding the first patch and the first and second antenna element ports feeding the second patch are arranged such that the distance between the first antenna element port of the first feed network and the first antenna element port of the second feed network is equal to the distance between the second antenna element port of the first feed network and the second antenna element port of the second feed network. The effect of coupling between the feeds at the feed input/output ports is negligible, because the two paths over which the coupled signal travels are 180° out of phase with one another at the input/output port of the feed network to which the signals are coupled, resulting in destructive interference and cancellation. Accordingly, unwanted energy from coupling between the feeds, which would normally cause interference, is removed, negating the effect of the coupling between the superimposed patches.

Additional features and advantages of embodiments of the disclosed invention will become more readily apparent from the following description, particularly when taken together with the accompanying drawings.

DETAILED DESCRIPTION

Figure 1:
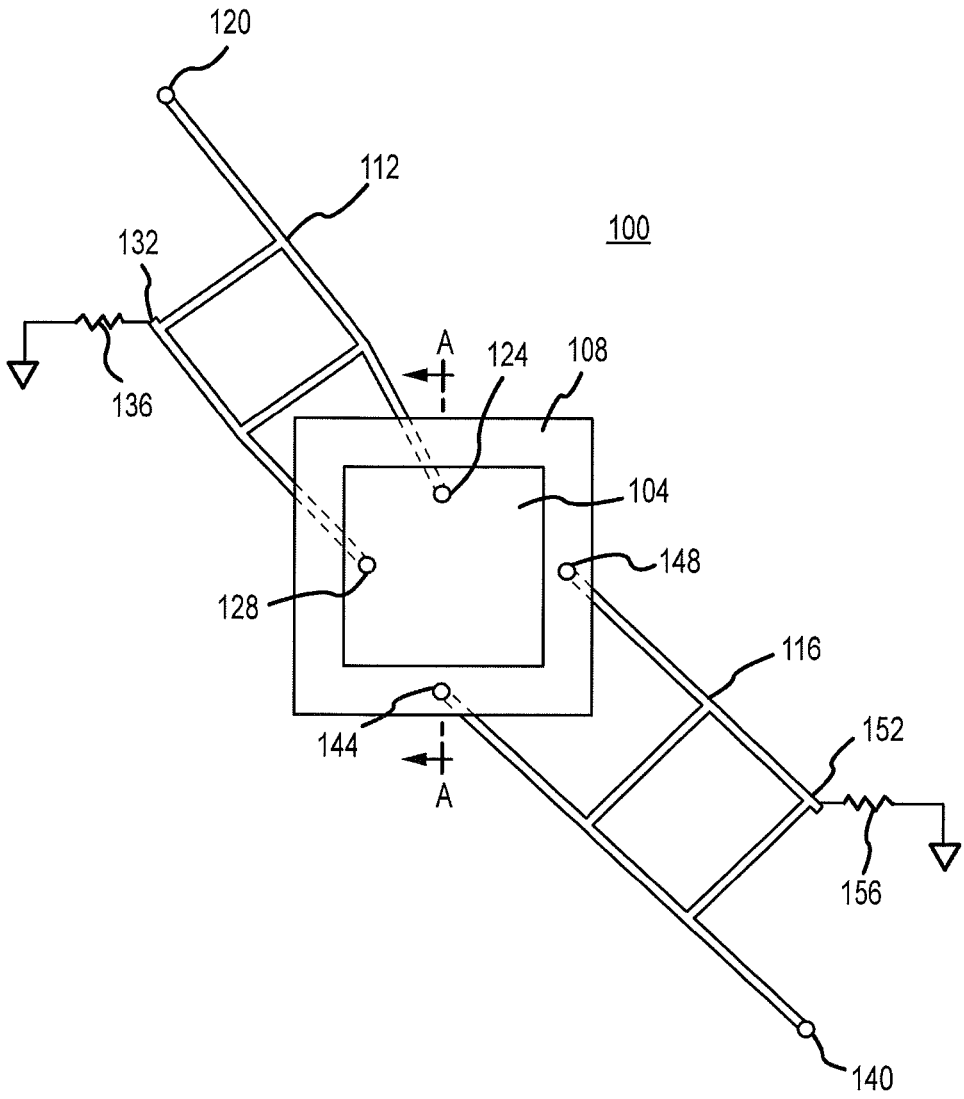
FIG. 1 is a depiction of an antenna system in accordance with embodiments of the described invention in plan view.

FIG. 1 depicts an antenna system 100 in accordance with embodiments of the disclosed invention in plan view. The antenna system 100 generally includes first 1011 and second 108 radiating elements or patches 104, 108. As shown, the first patch 104 is superimposed over or stacked with respect to the second patch 108. Moreover, as can be appreciated by one of skill in the art, the first patch 104 is dimensioned for use in connection with a first, relatively high (compared to the second patch 108) frequency or frequency band (i.e., a relatively short wavelength or range of wavelengths). The second patch 108 is dimensioned for use in connection with a second, relatively low (compared to the first patch 104) frequency or frequency band (i.e., a relatively long wavelength or range of wavelengths). Accordingly, the antenna system 100 is a dual band system. As illustrated, the first patch 104 and the second patch 108 can comprise round elements that are concentric with respect to one another.

The antenna system 100 also includes a first feed network 112, for transmitting signals to and/or from the first patch 104, and a second feed network 116 for transmitting signals to and/or from the second patch 108. The feed networks 112 and 116 comprise quadrature hybrid or 90° hybrid circuits. As can be appreciated by one of skill in the art, a quadrature hybrid circuit is a four port network that divides an input signal into two output signals, with one of the output signals being shifted 90° in phase with respect to the other output signal. In addition, a quadrature hybrid circuit is a reciprocal circuit. Accordingly, the first feed network 112 includes an input/output port 120 and a pair of patch or antenna element ports, including a first patch port or antenna element port 124 and a second patch port or antenna element port 128. The fourth or isolation port 132 is connected to ground via a resistor 136. Similarly, the second feed network 116 includes an input/output port 140 and a pair of patch or antenna element ports, including a first patch port or antenna element port 144 and a second patch port or antenna element port 148. The isolation port 152 of the second feed network is connected to ground via an isolation resistor 156.

Figure 2:
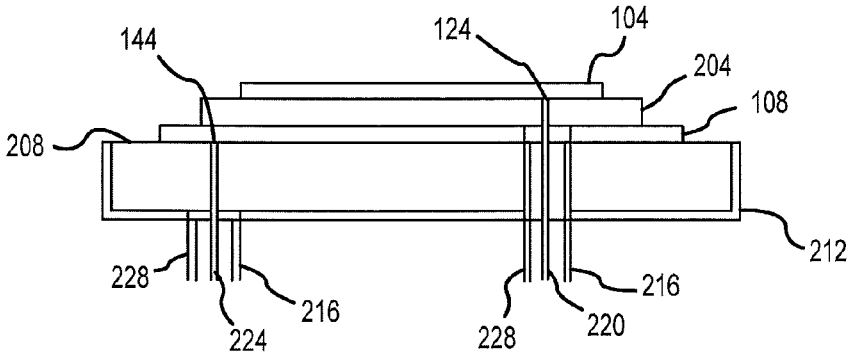
FIG. 2 is a cross section of the radiating elements of an antenna system in accordance with embodiments of the disclosed invention in elevation.

FIG. 2 is a cross-section of the exemplary embodiment illustrated in FIG. 1, taken along section line A-A (shown in FIG. 1), illustrating the patches 104 and 108 in elevation. As shown, the first patch 104 is supported by a support substrate 204 that is in turn supported by the second patch 108. As can be appreciated by one of skill in the art, the support substrate 204 may comprise a dielectric material with mechanical qualities that make it suitable for supporting the first patch 104 and for maintaining a desired separation and relative position of the first patch 104 with respect to the second patch 108. The second patch 108 is supported by a base substrate 208. The base substrate 208 may be formed from a dielectric material with mechanical qualities suitable for supporting and securing the second patch 108. The base substrate 208 may be supported and/or surrounded by a ground structure 212.

Feed lines connecting the feed networks 112 and 116, e.g., as shown in FIG. 1, to the antenna element ports may comprise coaxial cables 216. For instance, the center conductor 220 of a coaxial cable 216 associated with the first patch 104 may terminate at the first patch port 124 of the first pair of antenna element ports, while the center conductor 224 of the coaxial cable 216 associated with the second patch 108 may terminate at the first port 144 of the second pair of antenna element ports. The shield portion 228 of the coaxial cables 216 may be terminated at a ground structure associated with the patch 104 or 108 that is fed by that coaxial cable 216. For example, the shield 228 of a coaxial cable 216 connected to the first patch 104 may be connected to the second patch 108, which functions as a ground plane with respect to the first patch 104. Alternatively or in addition, the shield 228 of a coaxial cable connected to the first patch 104 may be connected to the ground structure 212. The shield 228 of a coaxial cable 216 connected to the second patch 108 may be connected to the ground structure 212. As can be appreciated by one of skill in the art, although coaxial cables 216 have been illustrated as connecting the feed networks 112 and 116 to the respective patches 104 and 108, striplines or other types of conductors can be used to establish these connections.

Figure 3:
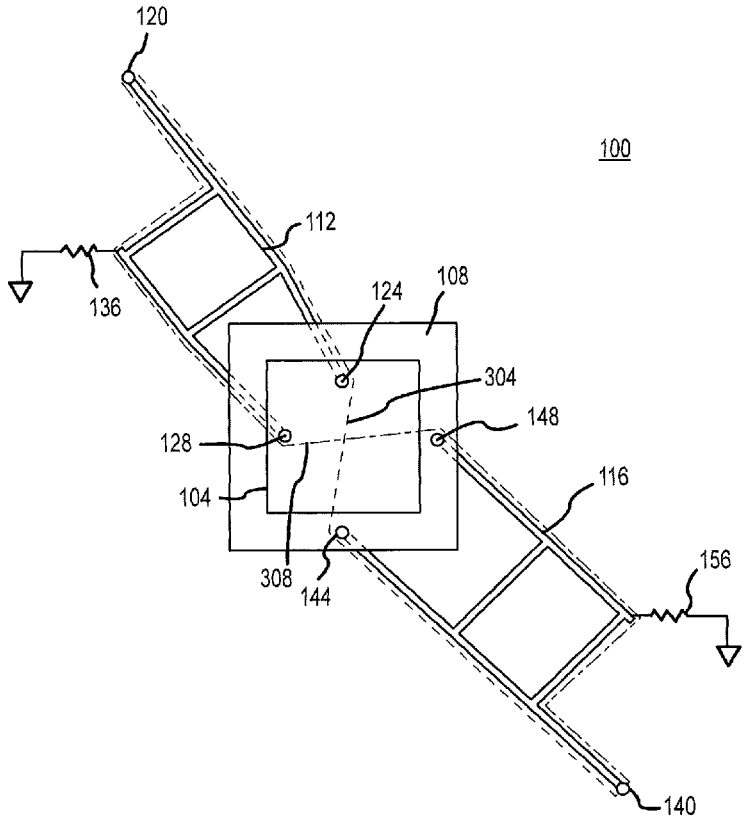
FIG. 3 illustrates the primary coupling paths in an antenna system in accordance with embodiments of the disclosed invention.

FIG. 3 illustrates coupling or signal paths between the first and the second feed networks 112, 116 of an antenna system 100 in accordance with embodiments of the disclosed invention. In particular, the first primary coupling path between the first and the second feed networks 112, 116 occurs between the first antenna element port 124 connecting the first feed network 112 to the first patch 104 and the first antenna element port 144 connecting the second feed network to the second patch 108 (also referred to herein as the third antenna element port 144). This coupling path is illustrated by the dashed line 304 in the figure. The second primary coupling path occurs between the second antenna element port 128 connecting the first feed network 112 to the first patch 104, and the second antenna element port 148 connecting the second feed network 116 to the second patch 108 (also referred to herein as the fourth antenna element port 148). This second coupling path is illustrated by the dash-dot line 308 in the figure.

In general, the path length of a first path extending between the input/output port 120 of the first feed network 112 and the first antenna element port 124 is less than the path length of a second path extending between the input/output port 120 of the first feed network 112 and the second antenna element port 128 by a distance corresponding to about a 90° phase shift for a signal having a wavelength within any of the operating wavelengths of the system 100. That is, a first component of a first signal that travels over the first path will lead a second component of the first signal that travels over the second path by 90 electrical degrees. In accordance with embodiments of the present invention, a phase shift is "about" a specified amount for any wavelength in a range of wavelengths if the phase shift of any wavelength within the range of wavelengths is that specified amount, plus or minus 5°. Similarly, the signal path length of a third path extending between the input/output port 140 of the second feed network 116 and the third antenna element port 144 is less than the signal path length of a fourth path extending between the input/output port 140 of the second feed network 116 and the fourth antenna element port 148 by a distance corresponding to about a 90° phase shift for a signal having a wavelength with any of the operating wavelengths of the system 100. In accordance with embodiments of the disclosed invention, the distance and thus the length of the coupling paths between the first antenna element ports 124 and 144 and the second antenna element ports 128 and 148 are the same. Therefore, as between the input/output port 120 of the first feed network 112 and the input/output port 140 of the second feed network 116, a signal having a first wavelength that is transmitted by the first input/output port 120 of the first feed network 112 and that is coupled to the second feed network 116 includes a first component that couples between the first antenna element ports 124 and 144 and a second component that couples between the second antenna element ports 128 and 148. Moreover, the first component is 180° out of phase with the second component at the first port 140 of the second feed network 116 at the input/output port 140 of the second feed network 116. This is because the electrical path length of the first coupling path 304 is shorter than the electrical path length of the second coupling path 308 by 180° (i.e., by ½ a wavelength). Therefore, the destructive interference cancels the unwanted energy. As can be appreciated by one of skill in the art, the canceled energy is generally dissipated in the isolation resistors 136 and 156. In accordance with embodiments of the present invention, the first 112 and the second 116 feed networks 112, 116 may provide operating characteristics that are identical to one another. In accordance with further embodiments of the present invention, the first and the second feed networks 112, 116 are designed to operate nominally between the operating bandwidth of the first patch 104 and the operating bandwidth of the second patch. For example, where the operating frequency of the first patch 104 is 2050 MHz and the operating frequency of the second patch 108 is 2250 MHz, the feed networks 112 and 116 may be designed to operate nominally at 2150 MHz.

Figure 4:
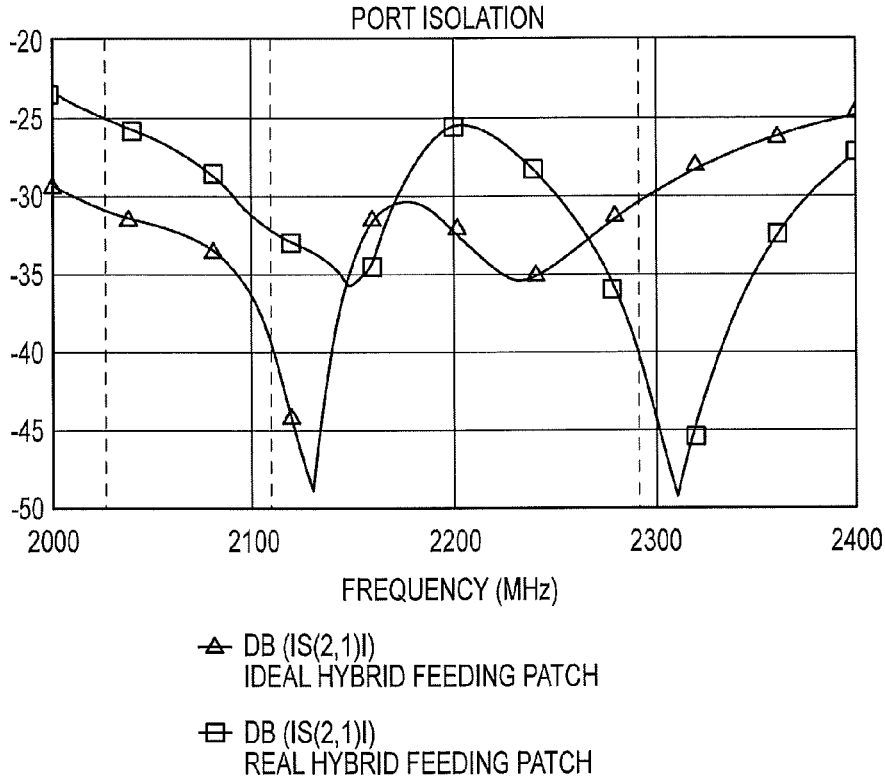
FIG. 4 is a graph depicting the isolation between the input/output ports of an exemplary antenna system in accordance with embodiments of the disclosed invention.

FIG. 4 is a graph depicting the isolation achieved by an exemplary antenna system 100 in accordance with embodiments of the disclosed invention. As shown, the isolation between the separate bandwidths is generally in excess of 25 dB. Accordingly, excellent isolation between the frequency bands is provided by the antenna system 100 of FIG. 1. Differences between the isolation predicted for an ideal system and the isolation measured in an exemplary system 100 depicted in FIG. 4 are due to non-ideal characteristics present in the feed networks 112 and 116 of FIG. 1. Differences in the isolation present at different signal frequencies (i.e., at different signal wavelengths) are due to the actual characteristics of the feed networks 112 and 116, and to variance from an exact 180° difference in electrical path length for signals at frequencies (i.e., wavelengths) that differ from the design center wavelength of the feed networks 112, 116. However, as demonstrated in FIG. 4, high levels of isolation can be obtained across a usefully wide range of operating wavelengths. In particular, effective cancellation can be achieved even where the components of the coupled signal are not exactly 180° out of phase at the input/output port 120 or 140 of FIG. 1 at which the signal is unwanted. For example, a phase difference of between 170° and 190° between the components of the coupled signal often results in sufficient cancellation to provide a desired level of isolation. As can be appreciated by one of skill in the art, a phase difference of 170° to 190° for a signal coupled between the input/output port 120 of the first feed network and the input/output port 140 of the second feed network can be achieved if that signal experiences a phase difference of 85° to 95° between the input/output port and the corresponding antenna element ports in each feed network 112 and 116. As can also be appreciated by one of skill in the art, depending on the application, a greater or lesser range of phase difference may result in sufficient suppression of coupled signals. For example, a total phase difference of between 160° and 200°, corresponding to phase differences of 80° to 100° in each feed network 112 and 116, may be acceptable in some applications. As a further example, a total phase difference of between 175° to 185° may be required. Accordingly, suppression of coupled signals can be achieved where the first patch 104 of FIG. 1 is used to transmit and/or receive signals within a first range of wavelengths and where the second patch 108 is used to transmit and/or receive signal within a second range of wavelengths.

Figure 5:
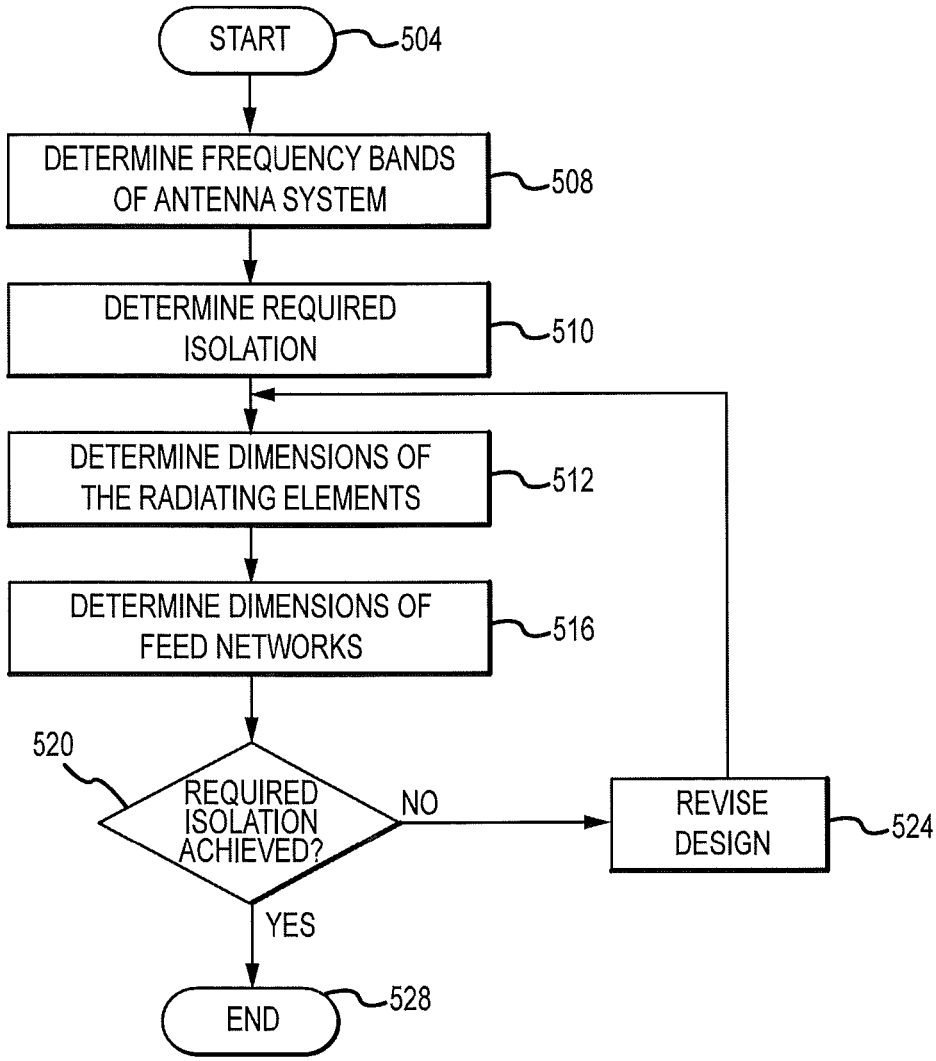
FIG. 5 is a flow chart depicting a method for providing a dual band isolated feed in accordance with embodiments of the disclosed invention.

As shown in FIG. 5, a method for implementing a dual band circularly polarized antenna system 100 of FIG. 1 in accordance with embodiments of the present invention can be started (step 504), and the two operating frequency bands of the antenna system 100 can then be selected or determined, for example from provided specifications (step 508). For instance, a proposed antenna system 100 might be required to have an ability to transmit a circularly polarized signal within a frequency range of 2.0 to 2.1 GHz, and to receive a circularly polarized signal within a frequency range of 2.2 to 2.3 GHz. The required isolation between frequency bands can also be determined from provided specifications (step 510). As can be appreciated by one of skill in the art, from the determined wavelengths of signals within the specified frequency bands, the dimensions and/or configuration of the first and the second radiating elements 104, 108 of FIG. 1 can be determined (step 512).

The characteristics of the feed networks 112 and 116 of FIG. 1 are also determined by the operating frequencies for the dual band antenna system 100. In particular, the feed networks 112 and 116 comprise quadrature hybrid circuits with a difference in path length that results in a phase difference of between 170° and 190° for a component of a signal that has a wavelength within the operating wavelengths of the antenna system and that travels between the input/output ports 120 and 140 along the first coupling path 304 as compared to a component of the signal traveling between the input/output ports 120 and 140 along the second signal path 308 shown in FIG. 3. The dimensions of the feed networks 112 and 116 can be determined at step 516.

At step 520, a determination can be made as to whether the desired isolation between the input/output port 120 of the first feed network 112 and the input/output port 140 of the second feed network 116 has been achieved. This determination can be made through computer simulation and/or building and testing an antenna system 100 that incorporates the determined dimensions. If the desired isolation is not achieved (i.e. No), the design can be revised (step 524), which can include revising the determined dimensions of the radiating elements and/or the feed networks. If the desired isolation has been achieved (i.e. Yes), the process may end (step 528).

Figure 6:
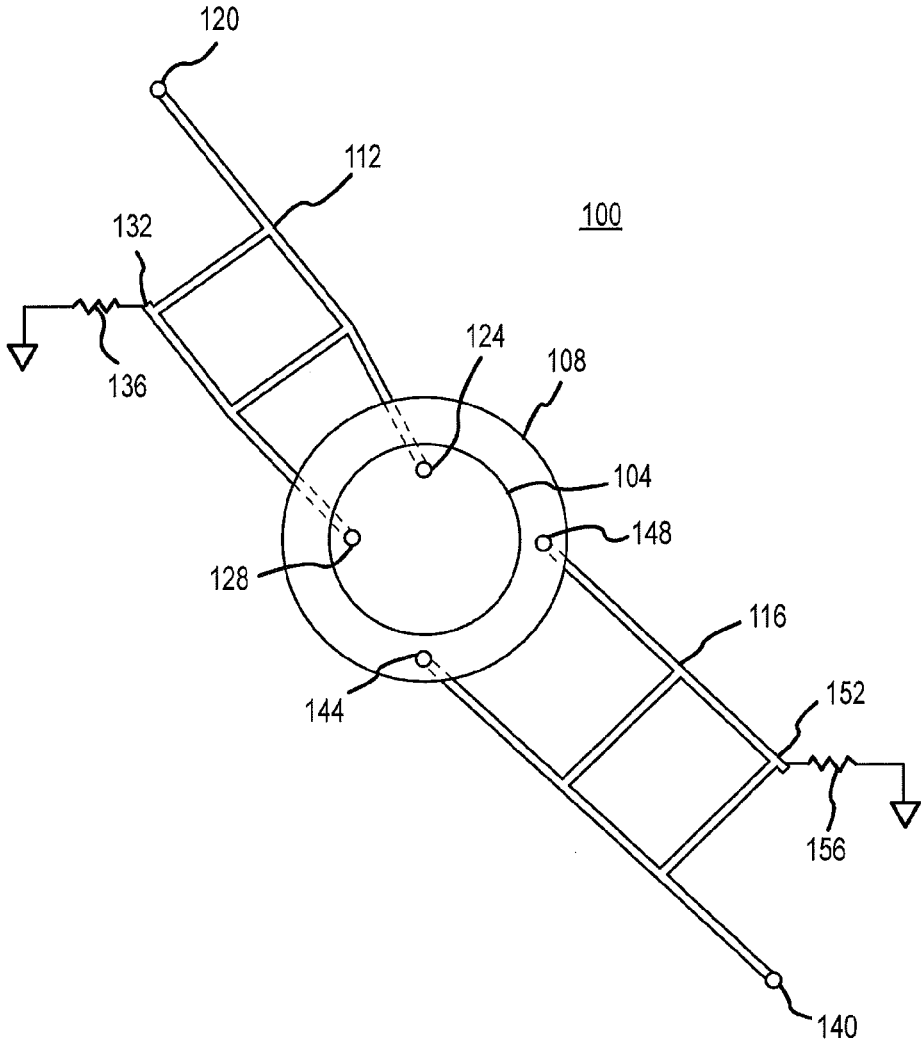
FIG. 6 is a depiction of an antenna system in accordance with other embodiments of the described invention in plan view.

FIG. 6 depicts an antenna system 100 in accordance with other embodiments of the disclosed invention in plan view. As shown in FIG. 6, the antenna system 100 according to such other embodiments can include first and second radiating elements or patches 104, 108 that are round or circular. In other respects, the components of the stem 100 of FIG. 6 can be the same or similar to those other components, as described in relation to other embodiments, for example as illustrated in FIG. 1. Accordingly, the numbering of the reference numbers associated with the components illustrated in FIG. 6 are the same as are used for like components illustrated in relation to other embodiments, for example as shown in FIG. 1.

As can be appreciated by one of skill in the art, an antenna system 100, e.g., as shown in FIG. 1, in accordance with embodiments of the disclosed invention may be incorporated into and associated with an electronic package that includes transmit and/or receive electronics. For example, where an antenna system 100 transmits at a relatively high frequency and receives at a relatively low frequency, the first port 120 of the first feed network 112 may be associated with a transmitter, while the first port 140 of the second feed network 116 may be associated with a receiver. In addition, an antenna system 100 as illustrated may be operated in conjunction with a number of other like or similar antenna systems 100 comprising an array of antenna systems 100. Moreover, antenna systems 100 in accordance with embodiments of the disclosed invention may be incorporated into a phased array antenna.

An antenna system 100 in accordance with embodiments of the disclosed invention may be implemented using known techniques. For example, the feed networks 112 and 116 may be implemented as strip lines formed on printed circuit board material. Similarly, the antenna radiating elements 104 and 108 may be formed using printed circuit board materials. Other known techniques may also be utilized. Moreover, the patches or radiating elements 104 and 108 can be square, round, rectangular, or other shapes or configurations.

The foregoing discussion of the invention has been presented for purposes of illustration and description. Further, the description is not intended to limit the invention to the form disclosed herein. Consequently, variations and modifications commensurate with the above teachings, within the skill or knowledge of the relevant art, are within the scope of the present invention. The embodiments described hereinabove are further intended to explain the best mode presently known of practicing the invention and to enable others skilled in the art to utilize the invention in such or in other embodiments and with various modifications required by the particular application or use of the invention. It is intended that the appended claims be construed to include alternative embodiments to the extent permitted by the prior art.

What is claimed is:

1. An antenna system, comprising:

a first radiating element;

a first feed network, including:

a pair of antenna element ports interconnected to the first radiating element;

an input/output port;

an isolation port resistor, wherein the first feed network provides a first signal path length between the input/output port of the first feed network and a first antenna element port of the pair of antenna element ports of the first feed network, wherein the first feed network provides a second signal path length between the input/output port of the first feed network and a second antenna element port of the pair of antenna element ports of the first feed network, and wherein for a signal having a first wavelength the first signal path length provided by the first feed network differs from the second signal path length provided by the first feed network by from 80 electrical degrees to 100 electrical degrees;

a second radiating element spaced apart from and superimposed over the first radiating element;

a second feed network, including:

a pair of antenna element ports interconnected to the second radiating element;

an input/output port;

an isolation port resistor, wherein the second feed network provides a first signal path length between the input/output port of the second feed network and a first antenna element port of the pair of antenna element ports of the second feed network, wherein the second feed network provides a second signal path length between the input/output port of the second feed network and a second antenna element port of the pair of antenna element ports of the second feed network, wherein for a signal having the first wavelength, the first signal path length provided by the second feed network differs from the second signal path length provided by the second feed network by from 80 electrical degrees to 100 electrical degrees, and wherein a distance between the first antenna element port of the pair of antenna element ports of the first feed network and the first antenna element port of the pair of antenna element ports of the second feed network is equal to a distance between the second antenna element port of the pair of antenna element ports of the first feed network and the second antenna element port of the pair of antenna element ports of the second feed network.

2. The antenna system of claim 1, wherein each one of the first and second radiating elements lie in parallel planes to each other, and wherein the first radiating element is stacked with respect to the second radiating element.

3. The system of claim 1, wherein for a signal having the first wavelength, a distance between the input/output port of the first feed network and the input/output port of the second feed network over a path including the first antenna element port of the first feed network and the first antenna element port of the second feed network differs from a distance between the input/output port of the first feed network and the input/output port of the second feed network over a path including the second antenna element port of the first feed network and the second antenna element port of the second feed network by between 170° and 190°.

4. The system of claim 1, wherein the first feed network is a first quadrature hybrid circuit, and wherein the second feed network is a second quadrature hybrid circuit.

5. The system of claim 1, wherein the first radiating element is dimensioned for operation at the first wavelength, wherein the second radiating element is dimensioned for operation at a second wavelength, and wherein the first feed network and the second feed network are designed to operate nominally in a range that includes the first wavelength and the second wavelength.

6. The system of claim 5, wherein the first and second wavelengths are different from one another.

7. The system of claim 6, wherein the first radiating element is round and has a first diameter, wherein the second radiating element is round and has a second diameter, and wherein the first and second diameters are different from one another.

8. The system of claim 7, wherein a center of the first radiating element and a center of the second radiating element lie along a common axis.

9. The system of claim 8, wherein the common axis is perpendicular to the first and second radiating elements.

10. The antenna system of claim 1, wherein a straight line between the first antenna element port of the first feed network and the first antenna element port of the second feed network defines a portion of a first coupling path, wherein a straight line between the second antenna element port of the first feed network and the second antenna element port of the second feed network defines a portion of a second coupling path, and wherein the portion of the first coupling path between the first antenna element port of the first feed network and the first antenna element port of the second feed network crosses the portion of the second coupling path between the second antenna element port of the first feed network and the second antenna element port of the second feed network.

11. The system of claim 1, wherein each one of the first and second radiating elements are planar and lie in parallel planes to each other, wherein a first feed line interconnects the first feed network to the first antenna element port of the first feed network, wherein a second feed line interconnects the first feed network to the second antenna element port of the first feed network, wherein a third feed line connects the second feed network to the first antenna element port of the second feed network, wherein a fourth feed line interconnects the second feed network to the second antenna element port of the second feed network, wherein each of the feed lines is perpendicular to the radiating elements, and wherein each of the first, second, third, and fourth feed lines are parallel to one another.

12. A system, comprising:

a first radiating element;

a first input/output port;

a first feed network interconnecting the first input/output port to the first radiating element at first and second antenna element ports, wherein a path length between the first input/output port and the first antenna element port and a path length between the first input/output port and the second antenna element port is different;

a second radiating element;

a second input/output port;

a second feed network interconnecting the second input/output port to the second radiating element at third and fourth antenna element ports, wherein a path length between the second input/output port and the third antenna element port and a path length between the second input/output port and the fourth antenna element port is different;

wherein a distance between the first antenna element port and the third antenna element port is equal to a distance between the second antenna element port and the fourth antenna element port, and wherein a first path between the first input/output port and the second input/output port that includes the first antenna element port and the third antenna element port has a first path length, wherein a second path between the first input/output port and the second input/output port that includes the second antenna element port and the fourth antenna element port has a second path length, and wherein the first and second path lengths are different.

13. The system of claim 12, wherein for a first wavelength the first path length differs from the second path length by one half of the first wavelength.

14. The system of claim 12, wherein for first and second wavelengths the first path length differs from the second path length by between 170° and 190°.

15. The system of claim 14, wherein the first radiating element is dimensioned to at least one of transmit and receive the first wavelength, and wherein the second radiating element is dimensioned to at least one of transmit and receive the second wavelength.

16. The system of claim 15, wherein the first radiating element is superimposed over the second radiating element.

17. The system of claim 16, wherein the first and second radiating elements are circular and are concentric with respect to one another.

18. The system of claim 12, wherein for a first wavelength the first path length differs from the second path length by between 160° and 200°.

* * * * *